United States Patent [19]

Olivieri et al.

[11] Patent Number: 4,685,226

[45] Date of Patent: Aug. 11, 1987

[54] SKI BOOT HAVING AN OPENING QUARTER FORMED OF MORE INTERCONNECTED PARTS

[75] Inventors: Icaro Olivieri, Westmount-Montreal, Canada; Leo Sartor, Caerano, Italy

[73] Assignee: Caber Italia S.p.A., Montebelluna, Italy

[21] Appl. No.: 586,601

[22] Filed: Mar. 6, 1984

[30] Foreign Application Priority Data

Mar. 17, 1983 [IT] Italy ..... 41539 A/83

[51] Int. Cl.[4] ..... A43B 5/04

[52] U.S. Cl. ..... 36/120; 36/105

[58] Field of Search ..... 36/117–121, 36/105

[56] References Cited

U.S. PATENT DOCUMENTS 3,793,749 2/1974 Gertsch et al. ..... 36/121
3,885,329 5/1975 French ..... 36/120
4,190,970 3/1980 Annovi ..... 36/117 X
4,455,768 6/1984 Salomon ..... 36/121

FOREIGN PATENT DOCUMENTS 2371162 6/1978 France ..... 36/121

*Primary Examiner*—James Kee Chi
*Attorney, Agent, or Firm*—Guido Modiano; Albert Josif

[57] ABSTRACT

The ski boot comprises a quarter formed of two complementary parts which partly overlap each other when closed along two vertically extending lateral centerlines. The rear part of the quarter is pivoted to the boot shell, and the quarter front part may be pivoted to the rear part, being guided by a cam arranged to slide over a stud which is rigidly attached to the shell and may be rotatably adjusted, the rotation of the rear part of the quarter, additionally to closing onto the front part, also moving a cuff-line member which closes the skier's foot instep.

8 Claims, 8 Drawing Figures

SKI BOOT HAVING AN OPENING QUARTER FORMED OF MORE INTERCONNECTED PARTS

BACKGROUND OF THE INVENTION

This invention relates to a ski boot of the type having an opening quarter formed of more parts.

There are various ski boot types with different constructions which have quarter opening capabilities to facilitate the introduction of the foot into the boot.

With such prior boots, the quarter conventionally comprises a single rear part which is movable and a front part which is stationary and practically integral with the shell.

The boot shell is also provided with closure devices in the form of mechanical linkages or locking arrangements, which enable the closure of the boot and the fixing of the foot instep.

SUMMARY OF THE INVENTION

It is a task of this invention to provide a ski boot structure which incorporates an opening quarter, which facilitates more effectively the introduction of the foot into the boot, and wherein rotation of the rear part of the boot quarter, during the closing step, also produces a closing action on the boot sheel front or foot instep.

Another object of the invention is to provide a ski boot quarter the rake of which is adjustable, so that its upright extension forms an adjustably variable angle with the longitudinal extension of the boot sole.

These and further tasks and objects which may be derived from the following description are achieved by the invention defined in the appended claims.

BRIEF DESCRIPTION OF THE DRAWINGS

The invention will be more readily understood from the following detailed description of preferred embodiments thereof, given herein by way of example and not of limitation with reference to the accompanying drawings, where.

DESCRIPTION OF THE PREFERRED EMBODIMENTS

Figure 1:
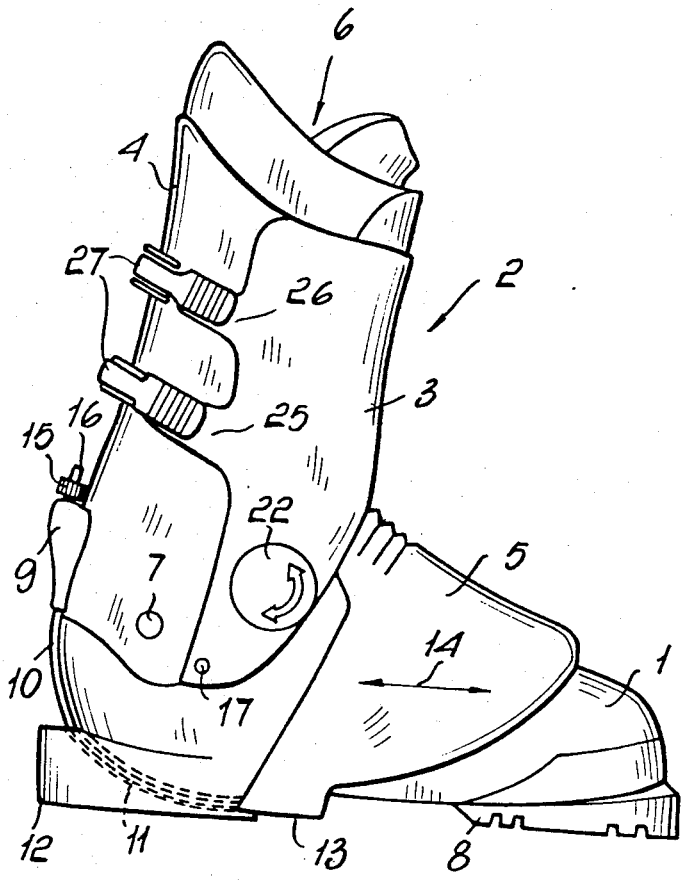
FIG. 1 shows a ski boot according to this invention, in the fully closed condition of the quarter.
Figure 2:
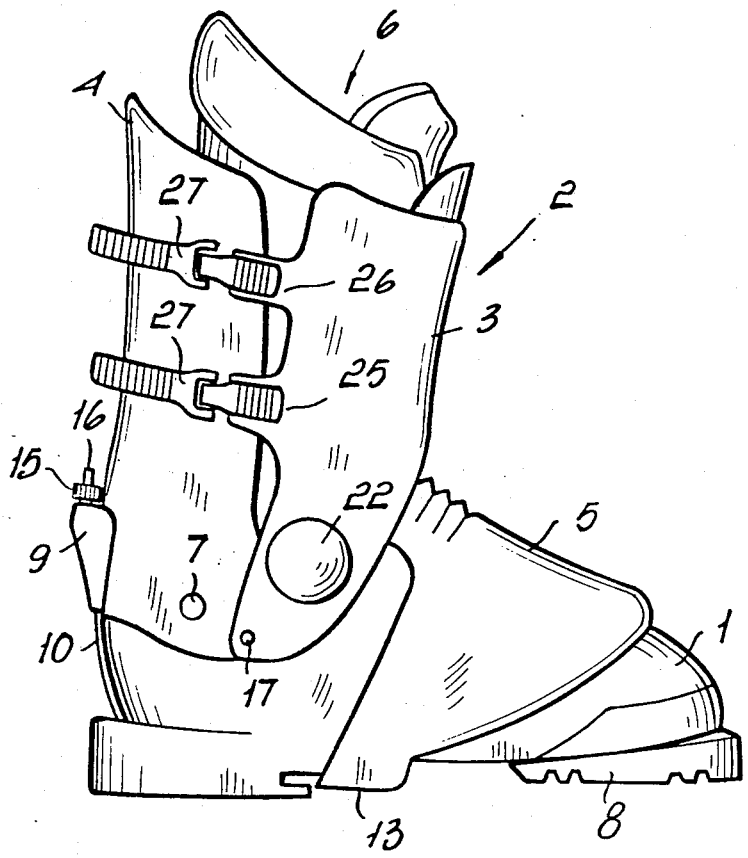
FIG. 2 shows the boot of FIG. 1 in the open condition of its quarter.
Figure 3:
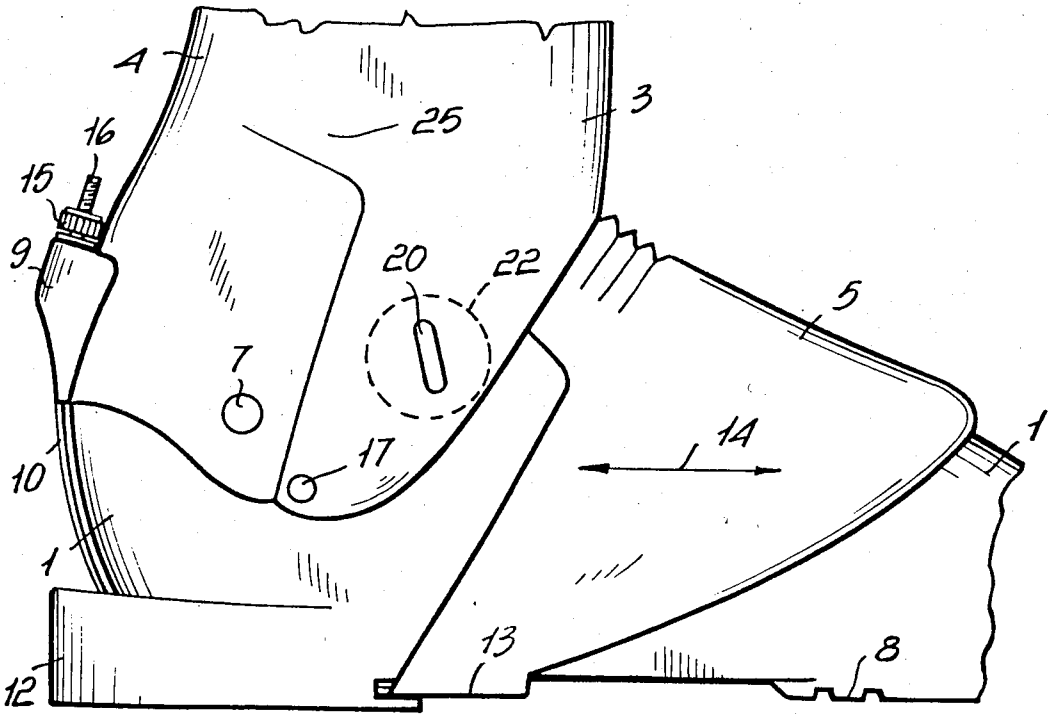
FIG. 3 is a detail view of the quarter pivotal region and cuff-like member which closes on the foot instep, with the boot in the fastened condition and the quarter closed.

Making reference to the drawing views which illustrate a first preferred embodiment, a ski boot according to this invention comprises essentially, as far as its external structure is concerned, a shell 1, a quarter 2, formed of a front part 3 and rear part 4 partly overlapping each other, and a cuff-like member or sleeve element, indicated at 5, which envelopes the front region of the shell 1 over the foot instep region.

Element 5 may either envelope entirely the instep region, i.e. including the sole portion thereof, or it may leave free at least the central part of the sole portion slidably engaging only with the edges thereof. Element 5 is mainly guided in its movement along the border surfaces of the sole.

The ski boot is then completed by a soft inner shoe, generally indicated at 6.

The rear part 4 of the quarter 2 is attached to the shell 1 through two pivotal connection points, one of which is shown and indicated at 7, the other being arranged symmetrically on the other side, which is not visible in the drawing.

An ideal line containing these two pivot points would lay parallel to the mean plane of the sole of the ski shoe or horizontally relatively to a ski boot resting with its sole 8 on a horizontal surface and transverse or perpendicularly to the longitudinal midplane of the shell 1.

The rear part 4 of the quarter 2 can thus be rotated about a transverse axis passing through the pivot points 7 to describe an arc extending parallel to the vertical midplane of the boot.

A tensioning link member 10 is attached by means of an adjutable device 9 to the rear part of the quarter 2, at the heel region thereof, said tensioning link member being passed through a groove 11 formed along the middle region of the heel 12 and connected to the lower middle portion 13 of the cuff-like member 5.

It may be readily appreciated that, as viewed in the drawing, by clockwise or anticlockwise rotating the rear part 4 of the quarter 2 about the pivot point 7, the cuff-like element 5 is respectively moved rearward to close and forward to open, as indicated by the double arrow 14.

Thus, it may be seen that on closing the quarter 2, i.e. on rotating clockwise the rear part 4, the lower part 13 of the element 5 and consequently the entire element 5 is also moved rearwardly which, in tightening on the foot instep region of the shell 1 causes the upper flaps, not shown and of conventional construction, to close, thereby locking the foot inside the boot.

This first closure function of the boot is controlled by acting on the device 9, e.g. by preliminarly adjusting the position of an adjustment nut 15 which is threaded onto a threaded end 16 forming the terminating portion of the link 10.

This anchoring and adjusting arrangement for the link 10 may be obviously implemented in any other way, such as through the use of a lever system with adjustment notches.

It is in all cases necessary that the link 10 be locked such that, once adjusted, the link member can operate both in tension and compression to move back and fourth the cuff-like member 5 and respectively release and compress the instep region of the shell 1.

For the purpose the tensioning link 10 is constituted of a flexible elongated member, such as a metallic tape or blade having sufficient resistance against buckling when compressed. A sufficiently strong Bowden cable could also be used.

The front part 3 of said quarter 2 is mounted at least with one portion thereof pivotally on the rear part 4, such as by means of two opposite lateral rivet elements one of which is visible in the drawings and indicated at 17.

Figure 4:
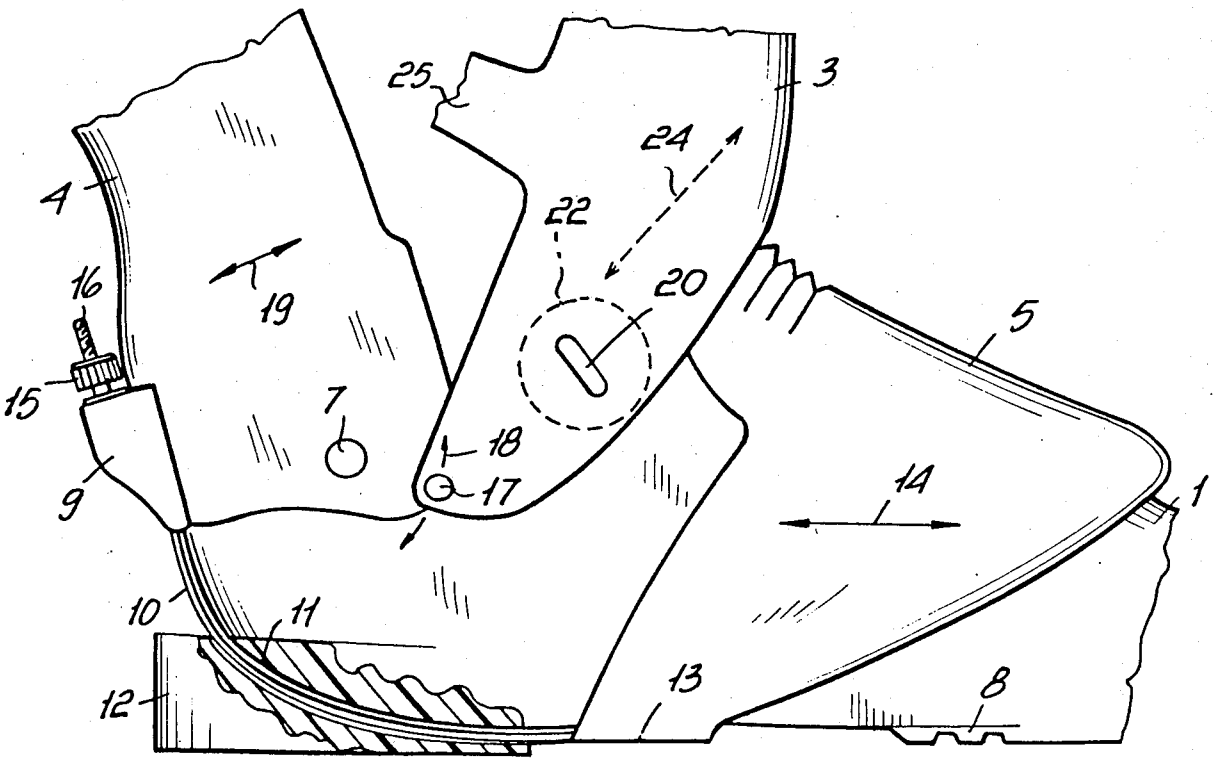
FIG. 4 is a detail view of the quarter pivotal connections in the opened condition.
Figure 5:
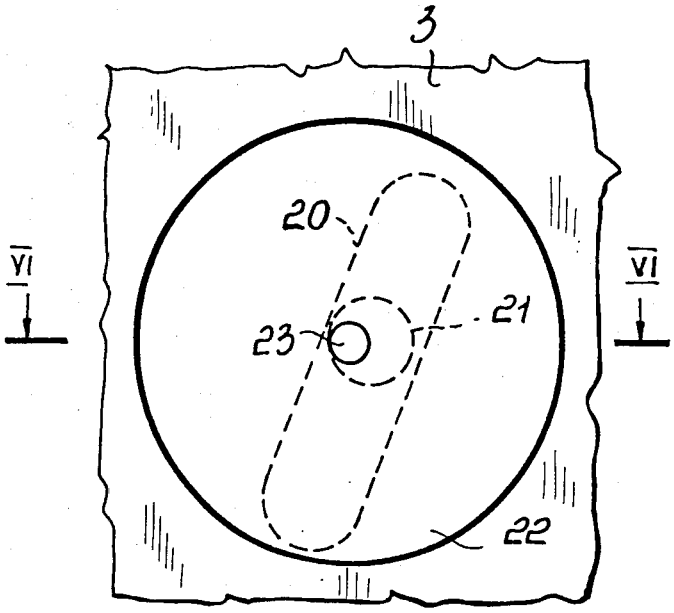
FIG. 5 is a detail view of the cam guiding the front part of the quarter.

Said pivot point 17 is located eccentrically with respect to the point 7, thereby it is forced to describe an arc indicated at 18 in FIG. 4 as the rear part 3 of the quarter 2 is moved as indicated by the arrow 19 in FIG. 4.

The front part 3 of the quarter 2 is also provided, on either sides of the boot, with an elongate slot cam 20 which slides, when part 3 is moved, over the stationary shank 21 of a respective stud or boss 22 connected to the shell 1 of the boot but allowed to turn about a pin 23 thereof.

Figure 6:
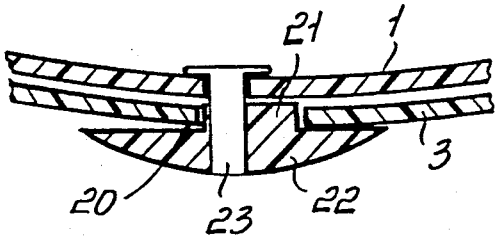
FIG. 6 is a sectional view taken along the line VI—VI of FIG. 5, showing the configuration of the stud which guides the cam on the quarter front part.

The shank 21 of said stud 22 which guides the cam 20 is located eccentrically with respect to the pin 23 of the stud 22. The shank 21 may either be provided with a through bore rotatably receiving therein the pin 23 connected to the shell 1 as visible in FIG. 6, or the pin 23 may be right with the stud 22.

It may be seen that by rotating now the rear part 4 of the quarter 2 in the anticlockwise direction of the arrow 19, the front part 3 of the quarter 2 is caused to move upwards and optionally rotated at the same time, approximately along a line in the upward direction of the arrow 24 in FIG. 4 and determined by the shape of the cam 20.

While the shape of the cam shown symbolically in the drawing is in the form of a rectilinear slot, it will be understood that the shape may be curvilinear in order that the movements dictated by the kinematic conditions may be performed. In this connection it should be noted that at least some of the component parts of the described boot structure are of resiliently yieldable character so that the kinematic conditions of movement are influenced by the deformability degree of the component parts. Thus, for example, the movement of part 3 in the direction of the arrow 24 shown in FIG. 4 would not be allowed under normal kinematic conditions. However, owing to the deformability factor with the simultaneous limited rotation of the cam 20, the composite movement of part 3 during the opening action of part 4 allows also a limited component movement in the direction of arrow 24.

In a modified embodiment, the cam 20 instead of being integral with member 3 may be provided by a disk member rotatorily embedded or retained in any other controllable manner in quarter part 3, so that the direction of the slot of the cam 20 can be adjusted by controllably rotating the disk which defines the cam, thereby regulating not only the relative movements of parts 3 and 4 with respect to the shell 1, but also the end positions of part 3.

Upon clockwise rotation of part 4 the closure of the quarter 2 is accomplished by two lugs, indicated at 25 and 26, respectively, which are provided with tightening lever devices 27 which, with the quarter in the closed condition, surround and tighten it in a permanent way.

The mutual operation of the various parts which make up this ski boot is apparent from the foregoing discussion, and the structure provided affords important advantages.

First, it should be noted that the quarter opens with relative spreading of two parts, thus facilitating introduction of the skier's foot.

It will be understood that the opening is not effected by merely pivoting the rear part 4 of the quarter 2 rearwards but also by an upward displacement and rotation (clockwise in FIG. 4) of the front part 3 brought about by the pivot point 17 and cam 20.

Thus, additionally to increasing the quarter opening, the link 10, in causing a forward movement of the cuff-like member 5, allows the instep region of the boot to be released. Under certain conditions, a certain action in the same forward direction is simultaneously effected by the member 3 on the upper part of element 5, where engagement of these two parts occurs.

By acting on the adjustment device 9 of the link 10, the foot instep may be tightened in a desired manner with the quarter 2 in the closed position.

Thus, once the ski boot has been adjusted to fit the foot structure of the skier, no further adjustment is required, and each time the quarter is closed, the foot instep is also automatically fastened with a desired compression.

As described above, the stud 22 has its shank 21 inserted through the cam 20 eccentrically with respect to its centerline pin 23 whereby it is connected to the shell 1.

Since the position of the cam 20, which as mentioned is formed in the front part 3 of the quarter 2, determines the angular position of the front part 3 with the quarter closed, it may be seen how, by rotating the stud 22, the angular position of the quarter centerline relatively to the resting surface of the sole may be adjusted within limits.

This practically allows the skier's position to be determined, who can select its preferred position by once for all adjusting the stud 22 and the other corresponding opposite stud, not shown in the drawings, which is located on the other side of the boot.

This operation may also be made once, as desired selected by the skier, and is in all cases retained during the opening and closing steps.

However, the skier can adjust, such as in the instance of the foot instep compression, whenever he/she finds it necessary, the stud positions and accordingly his/her position when using the boot.

Figure 7:
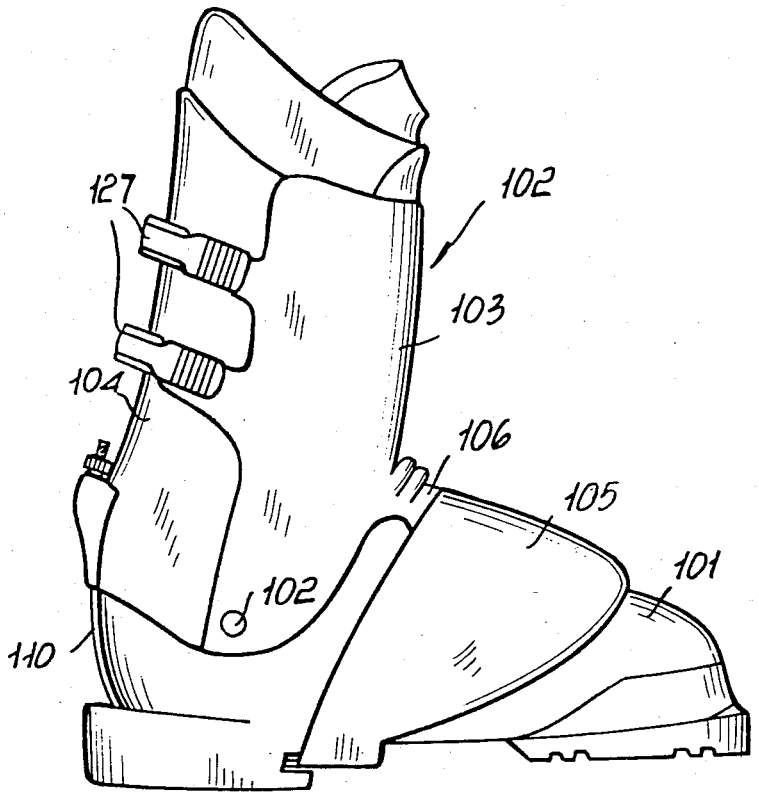
FIG. 7 shows a first modification of the boot of this invention.

In the first modified embodiment shown in FIG. 7, the quarter 102 of the boot again comprises a front part 103 and rear part 104, which are here both pivoted to the shell 101 through a single common pivot point indicated at 102.

In this embodiment, a large tongue 106 rigidly attached to the front part 103 of the quarter 102 is inserted under the cuff-like member 105 and can slide in flexing.

In this embodiment, the function of the rear part 104 is unchanged, which rear part is again connected by means of a link member 110 to the frusto-conical element 105 with the same function as illustrated hereinabove.

No longer provided is the same common action of the two parts 103 and 104 of the quarter 102, but the boot closing function is retained by mutual coaction of the part 104 and cuff-like member 105, as well as of the part 103 and part 104 by means of the tightening devices 127. However, the cooperation between parts 103 and 105 during the opening and closing action remains unchanged at the engagement zone between these two parts.

Figure 8:
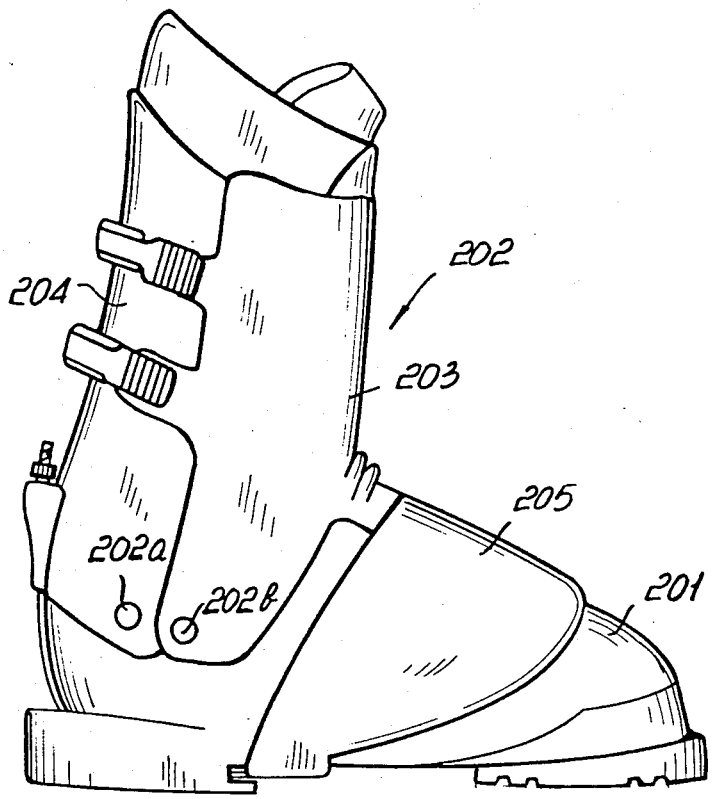
FIG. 8 shows a second modification of the ski boot according to the invention.

Shown in FIG. 8 is a further modified embodiment wherein the quarter, now indicated at 202, is again a two-piece construction including a front part 203 and rear part 204.

Each of said parts is individually pivoted to the shell 201 at two discrete pivot points, now indicated at **202*a* and 202*b***.

With an embodiment as illustrated, it is possible to select the best and most convenient pivot points separately for the rear part and front part of the quarter 202.

The rear element 204 in rotating about its pivot point 202*a*, again serves the function of acting on the frustoconical element, now indicated at 205, to accomplish a perfect closure of the boot.

All of the three embodiments just described achieve substantially the same objects and solve the same technical problem, and are, therefore, to be regarded as practically equivalent.

It should be further noted that the ski boot is neatly constructed, i.e. made free, at least at the front part which is the more exposed one, of such protruding devices as levers or other control means.

This is particularly convenient because it avoids the risk that the tightening devices may hit against obstructions in downhill skiing.

It may be appreciated from the foregoing description and illustration that all of the invention objects have been achieved, and in particular that a ski boot has been provided which is quite convenient during the foot introduction and withdrawal steps, and includes practical closure and adjustment arrangements for both the position and compression of the foot within the boot.

It should be also noted that the movements as a whole are substantially accomplished by dividing the quarter in two parts, and pivoting the rear part directly to the shell and having the front part pivoted to the rear one with its movement guided by a cam.

At the same time, the movement of the rear part of the quarter also controls release of the pressure of the foot instep.

Of course, based upon this same inventive idea, in practicing the invention similar and equivalent parts may be combined together which by working on the same principle can achieve the same objects.

In practicing the invention, the materials and dimensions may be any selected ones to meet individual requirements.

We claim:

1. A ski boot structure comprising a shell with a sole part and an upper part with an instep zone, an openable quarter on said shell, said quarter has a rear part and a front part mutually complementary and arranged to slightly overlap each other when closed, said rear part is hingedly connected to said shell, said front part is hingedly connected to said rear part at an eccentric location relatively to the hinge point of said rear part of said shell, a cuff-like member enclosing the front of said shell, an adjustable link member attached at said rear part and at said cuff-like member to move said cuff-like member contemporaneously with said rear part, at least a stud attached to said shell, a shank ortogonally protruding from said stud, said shank being positionable turning said stud, at least a slot cam arranged to slide along said shank for guiding said front part actuated by the movement of said rear part.

2. A ski boot as claimed in claim 1, wherein said quarter rear part is pivoted to a sub malleolar region of said shell and allowed to rotate about a parallel axis to the plane of the boot sole extending perpendicularly to the longitudinal centerline of the shell, an adjustable fastening device for said adjustable link member is provided at the heel region of said quarter, said link passes through a groove formed in the boot heel to impart, as the quarter rear part is rotated, a longitudinal translation movement of said cuff-like member locking the foot instep with an adjustable pressure determined by the adjustment of said link member on said fastening device.

3. A ski boot as claimed in claim 1, wherein the front part of said quarter being pivoted to the rear part at a different point from where the rear part is connected to the boot shell provides a lever arm during the rotation of said quarter rear part.

4. A ski boot as claimed in claim 1, wherein said front part has two slot cams at corresponding positions on either sides of the boot, said cams being guided by the shanks of two studs also provided at corresponding locations on either sides of the boot and made rigid with said shell although rotatable to adjust the position thereof and wherein said front part being articulated to said rear part causes said slot cams to act in such a way that as said rear part is rotated, said front part is upwardly displaced.

5. A ski boot as claimed in claim 4, wherein said shank of each of said studs is offset from the centerline of said stud therethrough it is coupled to said shell, to adjustably rotate said stud.

6. A ski boot as claimed in claim 4, wherein as said stud shank is rotated and positioned, said cam is displaced in such a way as to set said quarter in a different and adjustable closed position with respect to the plane of said sole.

7. A ski boot having an opening quarter, as claimed in claim 11, wherein said quarter is formed of two complementary parts, said two parts being both pivoted to the shell at the same coincident point both for the rear part and front part.

8. A ski boot as claimed in claim 1, wherein said quarter is formed of two parts, a front part and a rear part, said two parts being pivoted individually to the shell at different points.

* * * * *